US011206477B2

(12) United States Patent
Xiao et al.

(10) Patent No.: US 11,206,477 B2
(45) Date of Patent: Dec. 21, 2021

(54) SOUND TRANSDUCER STRUCTURE OF ELECTRONIC DEVICE

(71) Applicant: AAC Technologies Pte. Ltd., Singapore (SG)

(72) Inventors: Bo Xiao, Shenzhen (CN); Ronglin Linghu, Shenzhen (CN); Xiaodong Liu, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/989,912

(22) Filed: Aug. 11, 2020

(65) Prior Publication Data

US 2020/0413182 A1 Dec. 31, 2020

Related U.S. Application Data

(63) Continuation of application No. PCT/CN2019/094008, filed on Jun. 29, 2019.

(51) Int. Cl.
*H04R 1/02* (2006.01)
*H04R 1/28* (2006.01)

(52) U.S. Cl.
CPC ..... *H04R 1/2811* (2013.01); *H04R 1/021* (2013.01); *H04R 1/025* (2013.01); *H04R 1/2842* (2013.01); *H04R 1/2857* (2013.01); *H04R 2400/11* (2013.01); *H04R 2499/11* (2013.01)

(58) Field of Classification Search
CPC .... H04R 1/025; H04R 1/1008; H04R 1/2811; H04R 1/2842; H04R 1/2857; H04R 1/288; H04R 7/04; H04R 2400/11; H04R 2499/11; H04R 1/021; H04M 1/035
See application file for complete search history.

(56) References Cited

U.S. PATENT DOCUMENTS 4,742,887 A * 5/1988 Yamagishi ..... H04R 1/22 181/129
5,790,679 A * 8/1998 Hawker ..... H04M 1/0202 379/388.02
6,002,949 A * 12/1999 Hawker ..... H04M 1/0202 361/814
6,758,303 B2 * 7/2004 Zurek ..... H04R 5/02 181/155
7,233,678 B2 * 6/2007 Erixon ..... H04M 1/035 381/345
2013/0223655 A1 * 8/2013 Lee ..... H04R 1/34 381/189

* cited by examiner

*Primary Examiner* — Huyen D Le
(74) *Attorney, Agent, or Firm* — W&G Law Group

(57) ABSTRACT

The present invention provides a sound transducer structure of electronic device relating to the technical field of acoustics. The sound transducer structure includes a housing having an accommodating cavity, a sound generator received in the accommodating cavity, and a sound outlet disposed in the housing. A sound guiding groove communicates between the sound generator and the sound outlet, so that a sound generated at the sound generator is conducted along the sound guiding groove and is transmitted out of the housing from the sound outlet. The sound outlet includes a first sound outlet for transmitting sound in a receiver mode and a second sound outlet for transmitting sound in a loudspeaker mode. The second sound outlet is covered with a sound pressure sensitive member.

6 Claims, 3 Drawing Sheets

SOUND TRANSDUCER STRUCTURE OF ELECTRONIC DEVICE

FIELD OF THE PRESENT DISCLOSURE

The present disclosure relates to the technical field of acoustics, and more particularly to a sound transducer structure of an electronic device.

DESCRIPTION OF RELATED ART

Electronic devices in the prior art, such as mobile phones, have sound transducer structures at the top which may be used as receivers and loudspeakers, but noises such as airflow noise and the piano tone are produced in the loudspeaker mode.

Therefore, it is necessary to provide a sound transducer structure that may effectively solve the problem of airflow noise and the piano tone.

SUMMARY OF THE PRESENT DISCLOSURE

The present disclosure aims to provide a sound transducer structure of electronic device which may effectively solve the problem of airflow noise and the piano tone.

Technical scheme of the present disclosure is as follows: a sound transducer structure of electronic device is provided, the sound transducer structure includes a housing having an accommodating cavity, a sound generator received in the accommodating cavity, and a sound outlet arranged in the housing. A sound guiding groove communicates between the sound generator and the sound outlet, allowing a sound generated at the sound generator to be conducted along the sound guiding groove and transmitted out of the housing from the sound outlet. The sound outlet includes a first sound outlet for transmitting sound in a receiver mode and a second sound outlet for transmitting sound in a loudspeaker mode. The second sound outlet is covered with a sound pressure sensitive member.

In a further aspect, the sound pressure sensitive member is an air-permeable spacer.

In a further aspect, the housing includes a middle frame, a main body mounted in the middle frame, and a front cover covered on the main body. The first sound outlet is disposed in the main body, and the second sound outlet is disposed in the middle frame.

In a further aspect, the front cover is defined with a through hole at a position corresponding to the first sound outlet.

In a further aspect, a front cavity is formed by the sound generator together with the main body and the middle frame, and the sound guiding groove is disposed in the main body and communicated with the front cavity.

In a further aspect, the sound guiding groove includes a first groove section, the first sound outlet communicates with the first groove section at an end of the first groove section close to the front cover, and the second sound outlet communicates with the first groove section at a side of the first groove section close to the middle frame.

In a further aspect, the sound guiding groove also includes a second groove section perpendicular to and directly communicates with the first groove section, and the second sound outlet communicates with the second groove section at an end of the second groove section away from the first groove section.

The present disclosure has the following beneficial effects. According to the sound transducer structure of electronic device of the present disclosure, the sound and air pressure thereof is low in the receiver mode, and the sound is mostly transmitted out from the first sound outlet instead of the second sound outlet since it is difficult to go through the sound pressure sensitive member, corresponding to the status of the electronic device being applied close to user's ears; and the sound and air pressure thereof in the loudspeaker mode is high, and the sound may be transmitted out from the second sound outlet through the sound pressure sensitive material. Thereby, according to the sound transducer structure of the present disclosure, airflow and sound are split. Therefore, noises like airflow noise and the piano tone are reduced in the loudspeaker mode, and it is easier for the sound transducer structure in stereo to form a symmetrical sound field with a speaker at the bottom of the electronic device (such as a mobile phone).

DETAILED DESCRIPTION OF THE EXEMPLARY EMBODIMENT

The present disclosure will be further described below with reference to the drawings and embodiments.

Figure 1:
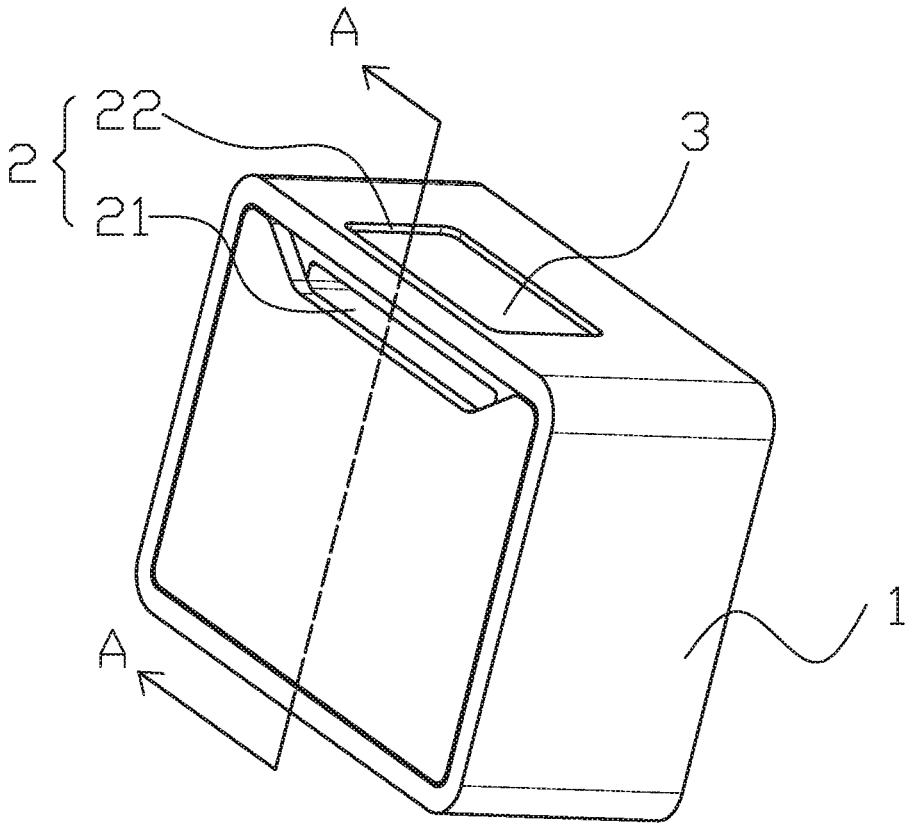
FIG. 1 is a perspective view of a sound transducer structure of electronic device according to the present disclosure.
Figure 2:
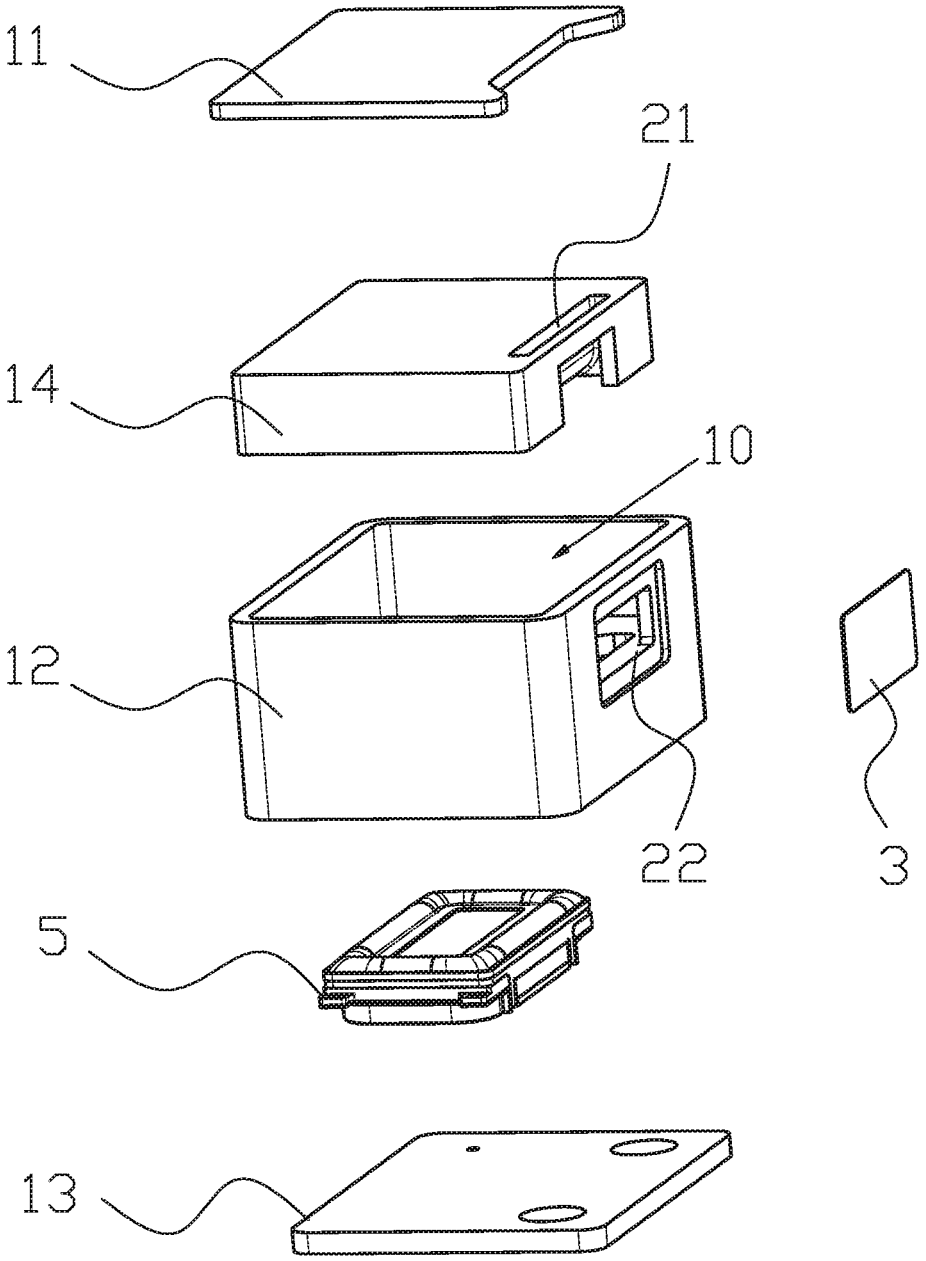
FIG. 2 is an exploded view of a sound transducer structure of electronic device according to the present disclosure.
Figure 3:
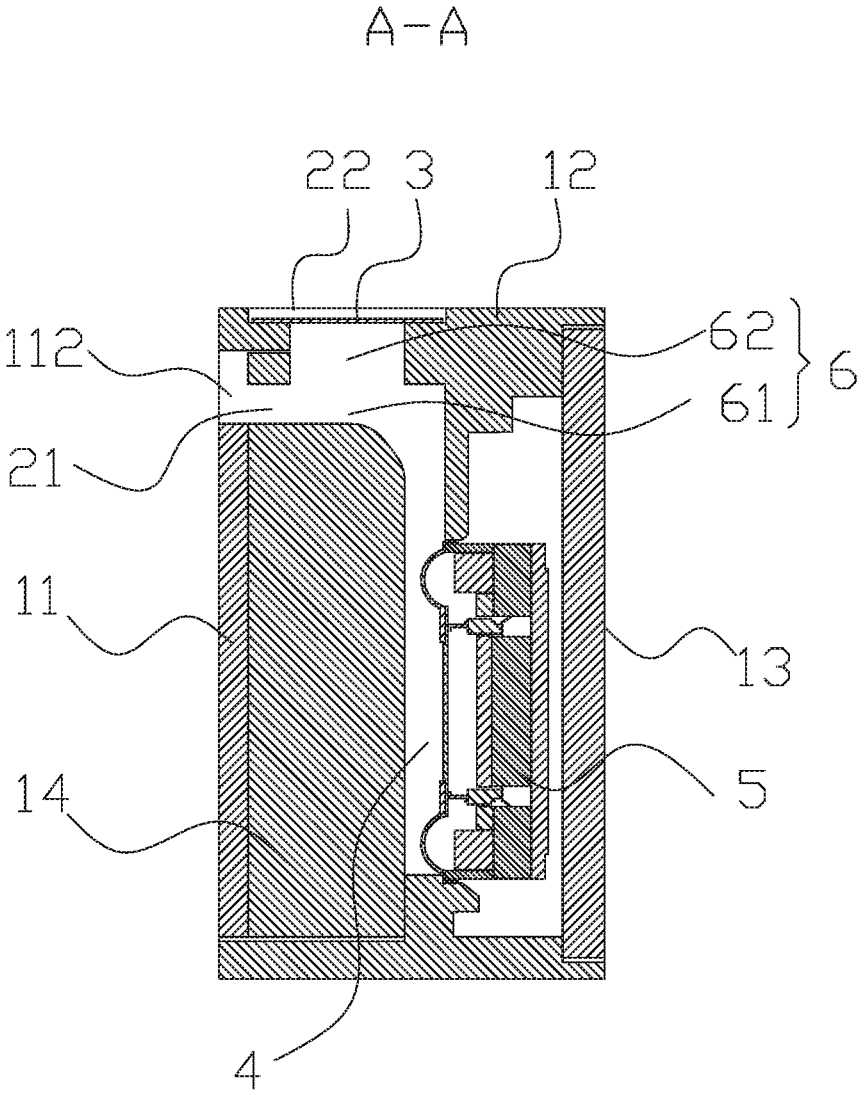
FIG. 3 is a cross-sectional view of the sound transducer structure of electronic device taken along line A-A of FIG. 1.

Referring to FIGS. 1 to 3, in an embodiment, the present disclosure provides a sound transducer structure of an electronic device. The sound transducer structure includes a housing 1 with an accommodating cavity 10, a sound generator 5 received in the accommodating cavity 10, and a sound outlet 2 defined in the housing 1. A sound guiding groove 6 communicates between the sound generator 5 and the sound outlet 2, so that a sound generated at the sound generator 5 is conducted along the sound guiding groove 6 and is transmitted out of the housing 1 from the sound outlet 2. That is, a sound is generated by the sound generator 5 in the housing 1, and the generated sound is transmitted through the sound guiding groove 6 in the housing 1, then to the sound outlet 2 in the housing 1 and finally out of the housing 1, thereby realizing the transmission of sound of the electronic device. The key of the technical scheme is that the sound outlet 2 includes a first sound outlet 21 for transmitting sound in a receiver mode and a second sound outlet 22 for transmitting sound in a loudspeaker mode, and the second sound outlet 2 is covered with a sound pressure sensitive member 3. That is, being different from the traditional scheme as separating a sound transducer structure corresponding to receiver mode from a sound transducer structure corresponding to loudspeaker mode, the sound transducer structure of the present disclosure combines both. The two modes may share one sound generator 5 and one sound guiding groove 6, and different sound outlets being correspondingly arranged. The sound and air pressure of the sound transducer structure is low in the receiver mode, and the sound is mostly transmitted out from the first sound outlet 21 instead of the second sound outlet 22 since it is difficult to go through the sound pressure sensitive member 3, corresponding to the status of the electronic device being applied close to user's ears; and the sound and air pressure of the sound transducer structure in the loudspeaker mode is high, and the sound may be transmitted out from the second sound outlet 22 through the sound pressure sensitive member 3. Thereby, according to the sound transducer structure of the present disclosure, airflow and sound are split. Therefore, noises like airflow noise and the piano tone are reduced in the loudspeaker mode, and it is easier for the sound transducer structure in stereo to form a symmetrical sound field with a speaker at the bottom of the electronic device (such as a mobile phone).

In one embodiment, the sound pressure sensitive member 3 is an air-permeable spacer, and optionally may be a mesh or a metal mesh to obtain better sound quality.

In one embodiment, the housing 1 includes a middle frame 12, a main body 14 mounted in the middle frame 12, and a front cover 11 covered on the main body 14. The first sound outlet 21 is disposed in the main body 14, and the second sound outlet 22 is disposed in the middle frame 12. In case of the receiver mode, the sound is transmitted out from the front cover 11, making it more convenient for usage as the front cover 11 may be closely attached to a user's ear. In addition, the second sound outlet 22 is arranged at the top of the housing 1. In the loudspeaker mode, the sound is transmitted out from the middle frame 12, making it convenient for loudspeaker sound out.

In one embodiment, the front cover 11 is provided with a through hole 112 at a position corresponding to the first sound outlet 21, so that the sound may be transmitted from the first sound outlet 21 and then out the through hole 112 in the front cover 11.

In one embodiment, a front cavity 4 is formed by the sound generator 5 together with the main body 14 and the middle frame 12. The sound guiding groove 6 is provided in the main body 14 and is communicated with the front cavity 4, allowing the sound to be transmitted from the front cavity 4 through the sound guiding groove 6 and then out the sound outlet 2.

Referring to FIG. 3, in one embodiment, the sound guiding groove 6 includes a first groove section 61, the first sound outlet 21 communicates with the first groove section 61 at an end of the first groove section 61 close to the front cover 11, that is the first groove section 61 directly communicates with the first sound outlet 21; and the second sound outlet 22 communicates with the first groove section 61 at a side of the first groove section 61 close to the middle frame 12 which is at the top of the housing 1. It can be understood that the first sound outlet 21 is arranged at an end of the extending direction of the first groove section 61, and the second sound outlet 22 is arranged at a side of the extending direction of the first groove section 61. The sound and air pressure of the sound transducer structure is low in the receiver mode, most of the sound may be finally transmitted along the sound guiding groove 6 to the end of the first groove section 61 and out the first sound outlet 21, corresponding to the electronic device being applied close to user's ears; and the sound and air pressure of the sound transducer structure in the loudspeaker mode is high, the sound may be transmitted out of the second sound outlet 22 at a side of the first groove section 61 through the sound pressure sensitive material 3, thereby realizing the sound out.

In addition, based on the previous embodiment, the sound guiding groove 6 also includes a second groove section 62 perpendicular to and directly communicates with the first groove section 61, and the second sound outlet 22 is communicated with the second groove section 62 at an end of the second groove section 62 away from the first groove section 61, allowing the sound generated by the sound generator 5 to be transmitted out from the second sound outlet 22 through the second groove section 62.

The description above is only some embodiments of the present disclosure. It should be pointed out here that for those of ordinary skill in the art, improvements can be made without departing from the inventive concept of the present disclosure, which are all within the scope of protection of the present disclosure.

What is claimed is:

1. A sound transducer structure of electronic device, comprising:

a housing having an accommodating cavity;

a sound generator received in the accommodating cavity; and a sound outlet disposed in the housing;

a sound guiding groove communicating between the sound outlet and the sound generator, allowing a sound generated from the sound generator to be conducted along the sound guiding groove and transmitted out of the housing from the sound outlet; wherein the sound outlet comprises a first sound outlet for transmitting sound in a receiver mode and a second sound outlet for transmitting sound in a loudspeaker mode, and the second sound outlet is covered with a sound pressure sensitive member, the housing comprises a middle frame, a main body mounted in the middle frame, and a front cover arranged on the main body, the first sound outlet is disposed in the main body, and the second sound outlet is disposed in the middle frame.

2. The sound transducer structure according to claim 1, wherein the sound pressure sensitive member is an air-permeable spacer.

3. The sound transducer structure according to claim 1, wherein the front cover is defined with a through hole at a position corresponding to the first sound outlet.

4. The sound transducer structure according to claim 3, wherein a front cavity is defined by the sound generator together with the main body and the middle frame, and the sound guiding groove is provided in the main body and communicating with the front cavity.

5. The sound transducer structure according to claim 4, wherein the sound guiding groove comprises a first groove section, the first sound outlet communicates with the first groove section at an end of the first groove section close to the front cover, and the second sound outlet communicates with the first groove section at a side of the first groove section close to the middle frame.

6. The sound transducer structure according to claim 5, wherein the sound guiding groove further comprises a second groove section perpendicular to and directly communicates with the first groove section, and the second sound outlet communicates with the second groove section at an end of the second groove section away from the first groove section.

* * * * *